US009130295B2

(12) United States Patent
Nguyen Nhu et al.

(10) Patent No.: US 9,130,295 B2
(45) Date of Patent: Sep. 8, 2015

(54) ELECTRICAL PLUG CONNECTOR

(75) Inventors: Lam Nguyen Nhu, Bensheim (DE); Uwe Gassauer, Erzhausen (DE); Stefan Konrad Nagel, Göppingen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 3 days.

(21) Appl. No.: 13/816,732

(22) PCT Filed: Aug. 8, 2011

(86) PCT No.: PCT/EP2011/063630

§ 371 (c)(1),
(2), (4) Date: Feb. 12, 2013

(87) PCT Pub. No.: WO2012/020000

PCT Pub. Date: Feb. 16, 2012

(65) Prior Publication Data

US 2013/0143424 A1 Jun. 6, 2013

(30) Foreign Application Priority Data

Aug. 13, 2010 (DE) ..... 10 2010 039 314

(51) Int. Cl.

| | |
|---|---|
| ***H01R 13/58*** | (2006.01) |
| ***H01R 13/447*** | (2006.01) |
| ***H01R 13/50*** | (2006.01) |
| ***H01R 43/00*** | (2006.01) |

(Continued)

(52) U.S. Cl.

CPC ..... *H01R 13/447* (2013.01); *H01R 13/501* (2013.01); *H01R 43/00* (2013.01); *H01R 9/03* (2013.01); *H01R 13/506* (2013.01); *H01R 13/5213* (2013.01); *H01R 13/64* (2013.01); *H01R 13/65802* (2013.01); *Y10T 29/49208* (2015.01)

(58) Field of Classification Search

CPC ..... H01R 13/501
USPC ..... 439/467, 466, 468, 473
See application file for complete search history.

(56) References Cited

U.S. PATENT DOCUMENTS 4,558,916 A * 12/1985 Hehl ..... 439/467
5,860,834 A * 1/1999 Sugiyama ..... 439/595

(Continued)

FOREIGN PATENT DOCUMENTS

DE 102006016882 A1 10/2007
EP 1401052 A1 3/2004

(Continued)

OTHER PUBLICATIONS

International Preliminary Report on Patentability issued by the International Bureau of WIPO, Geneva, Switzerland, dated Feb. 19, 2013, for related International Application No. PCT/EP2011/063630; 5 pages.

(Continued)

*Primary Examiner* — Felix O Figueroa
(74) *Attorney, Agent, or Firm* — Faegre Baker Daniels LLP

(57) ABSTRACT

In an electrical plug connector comprising an insulating contact adapter the contact adapter has a first wing which can be pivoted between an open and a closed position. The contact adapter is designed to enclose a metal contact element between the first wing and a wall of the contact adapter when the first wing is in the closed position.

19 Claims, 13 Drawing Sheets

(51) Int. Cl.

| | |
|---|---|
| *H01R 9/03* | (2006.01) |
| *H01R 13/506* | (2006.01) |
| *H01R 13/52* | (2006.01) |
| *H01R 13/64* | (2006.01) |
| *H01R 13/658* | (2011.01) |

(56) References Cited

U.S. PATENT DOCUMENTS

| | | | | |
|---|---|---|---|---|
| 6,179,663 | B1 | 1/2001 | Bradley et al. | |
| 6,666,708 | B2 * | 12/2003 | Saito | 439/466 |
| 6,712,646 | B2 * | 3/2004 | Shindo | 439/607.07 |
| 6,783,386 | B2 * | 8/2004 | Clement | 439/467 |
| 6,817,899 | B1 | 11/2004 | Zerebilov | |
| 7,309,257 | B1 | 12/2007 | Minich | |
| 7,458,852 | B2 * | 12/2008 | Gunreben | 439/596 |
| 2002/0137397 | A1 | 9/2002 | Little | |
| 2003/0178219 | A1 | 9/2003 | Kuroda et al. | |
| 2004/0038591 | A1 | 2/2004 | Clement et al. | |
| 2007/0105442 | A1 | 5/2007 | Gunreben | |
| 2010/0068927 | A1 | 3/2010 | Ho | |

FOREIGN PATENT DOCUMENTS

| | | | |
|---|---|---|---|
| EP | 1786069 | A1 | 5/2007 |
| EP | 2105997 | A2 | 9/2009 |

OTHER PUBLICATIONS

International Search Report and Written Opinion issued by the European Patent Office, dated Sep. 26, 2011, for related International Application No. PCT/EP2011/063630; 10 pages.

Office Action issued by the German Patent and Trademark Office dated Apr. 13, 2011 for related German Application No. 10 2010 039 314.2; 6 pages.

* cited by examiner

ELECTRICAL PLUG CONNECTOR

The invention relates to an electrical plug connector according to the preamble of claim 1 and to a method for assembling an electrical plug connector according to the preamble of claim 14.

Various embodiments of electrical plug connectors are known. In electrical plug connectors for transferring high-frequency signals it is desirable for the plug connector to change the impedance of the signal line only to a minimal extent. For this purpose it is known to guide the individual cores of a cable within the plug connector in an insulating body. Plug connectors of this type are described, for example, in DE 20 2004 019 277 U1, in EP 1 641 089 B1 and in U.S. Pat. No. 6,616,482 B2. EP 0 971 449 B1 describes a plug connector in which an electrical contact is fixed by a lockable holding means in a chamber.

The object of the present invention is to provide a plug connector which is improved compared to the known solutions. This object is achieved by an electrical plug connector having the features of claim 1. A further object of the present invention is to provide an improved method for assembling an electrical plug connection. This object is achieved by a method having the features of claim 14. Preferred developments are disclosed in the dependent claims.

An electrical plug connector according to the invention comprises an insulating contact adapter which has a first wing which can be pivoted between an open and a closed position. The contact adapter is designed to enclose a metal contact element between the first wing and a wall of the contact adapter when the first wing is in the closed position. This electrical plug connector is advantageously easy to assemble. The contact element can be fixed reliably in the electrical plug connector by the wing. In addition, the electrical plug connector has only a small number of individual components and can be produced cost effectively.

The first wing preferably comprises a guide groove for receiving the contact element. This advantageously also facilitates the assembly of the plug connector.

In a development of the electrical plug connector the guide groove comprises a curved portion which extends over an angle of approximately 90°. A right-angled plug connector is advantageously produced.

The contact adapter preferably comprises a base part having a contact through-opening for receiving a socket region of the contact element. The contact opening can advantageously be used for the insertion of a counterpart of the electrical plug connector.

At least one rib is particularly preferably arranged in the contact opening to fix the contact element. The rib may advantageously be used as a first contact security means.

In a particularly preferred embodiment of the electrical plug connector the first wing is connected to the contact adapter via a living hinge. Such a living hinge can advantageously be produced in a particularly simple and cost-effective manner.

The first wing expediently comprises a locking element which is provided to lock the first wing in its closed position. Accidental disassembly of the plug connector is thus advantageously effectively prevented.

In a development of the electronic plug connector the contact adapter comprises a second wing which can be pivoted in the opposite direction to the first wing between an open and a closed position. The plug connector may then advantageously be used to contact a plurality of cores of a cable.

Each of the wings particularly preferably comprises two guide grooves for receiving two contact elements each. The plug connector can then advantageously be used to connect a cable having four cores.

The plug connector expediently comprises a shielding housing and a spring element connected to the shielding housing, wherein the contact adapter can be locked in the shielding housing. The shielding housing advantageously provides the plug connector with an electromagnetic shielding.

The plug connector preferably also comprises a cover sheet which is designed to be positioned on the shielding housing and crimped with a cable. The electrical plug connector is then advantageously shielded in all spatial directions.

In a development the electrical plug connector also comprises a coding member having at least one coding element. The coding member can then advantageously ensure that the electrical plug connector is connected to the correct counterpart. The plug connector is thus effectively prevented from being inserted into an incorrect counterpart.

The plug connector is preferably provided for the transfer of a high-frequency signal.

A method according to the invention for assembling an electrical plug connector comprises steps for bending a contact element connected to a core of a cable in such a way that the contact element extends in a curved portion over an angle of approximately 90°, for inserting an end portion of the contact element into a contact opening in a contact adapter, and for pivoting a wing of the contact adapter into a closed position in such a way that the curved portion of the contact element is enclosed between the wing and a wall of the contact adapter. This method is advantageously very simple to implement and can even be automated.

In a preferred development of the method, four contact elements connected to four cores of the cable are bent, wherein two of the contact elements are bent with a smaller bend radius and two of the contact elements are bent with a larger bend radius. In addition, two wings of the contact adapter are then pivoted in closed positions in such a way that, in each case, two contact elements are enclosed between each of the wings and the wall of the contact adapter. This method advantageously provides a plug connector having four contacts and can also be carried out very easily and even by machine.

The invention will be described in greater detail hereinafter with reference to the drawings, in which.

Figure 17:
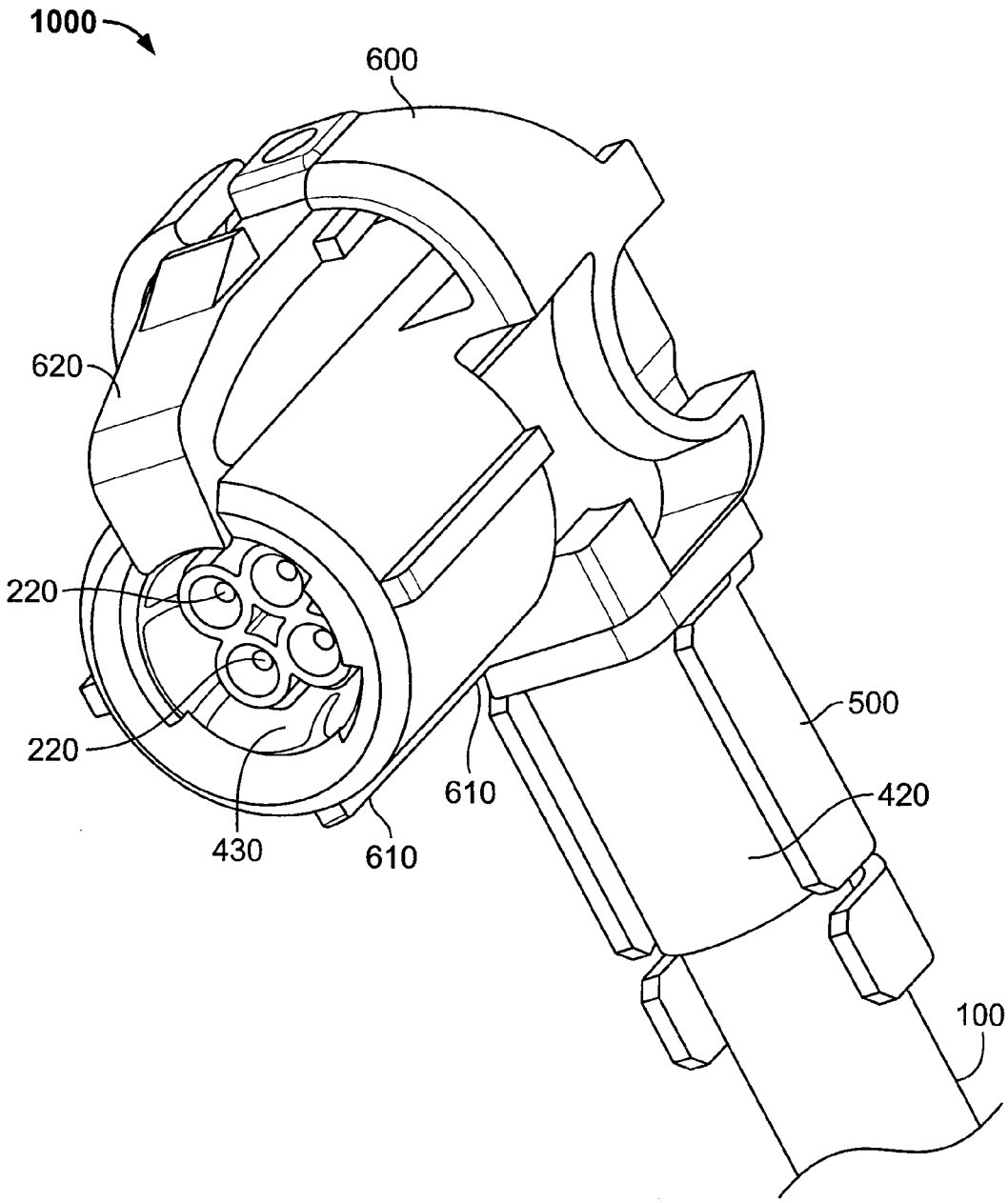
FIG. 17 shows a fully assembled plug connector with a coding member and a shielding housing inserted therein.

FIG. 17 shows a perspective view of an electrical plug connector 1000. The electrical plug connector connects a cable 100 having four cores to a matching counterpart of the plug connector 1000. The electrical plug connector 1000 is particularly adapted for the transfer of high-frequency signals. For example, the electrical plug connector 1000 may be used to transfer one or more high-frequency data signals. In particular, the electrical plug connector 1000 may be an HSD plug connector. The electrical plug connector 1000 may be used, for example, in a motor vehicle. The construction and assembly of the electrical plug connector 1000 will be described hereinafter.

Figure 1:
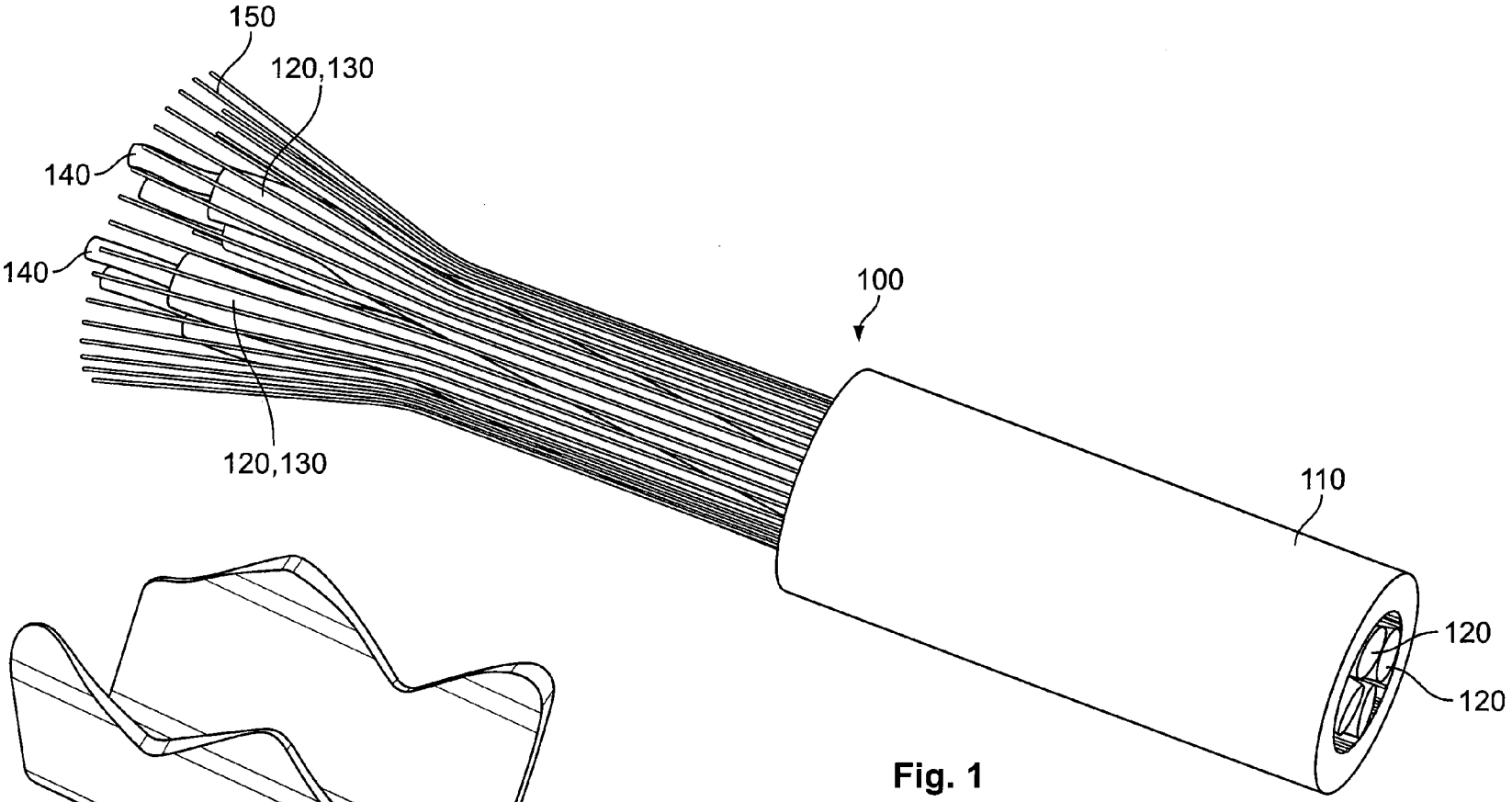
FIG. 1 shows a cable with four cores.

FIG. 1 shows a perspective view of a cable 100. The cable 100 comprises four cores 120. Each of the cores 120 consists of a conductive wire 140 which is sheathed by an electrically insulating core insulation 130. The four cores 120 of the cable 100 are jointly sheathed by a shielding braid 150. The shielding braid 150 is electrically conductive and shields the cable 100 electromagnetically against the surrounding environment. The shielding braid 150 and the cores 120 arranged therein are jointly sheathed by a cable sleeve 110 made of electrically insulating material. The cable 100 may be used, for example, to transfer high-frequency electromagnetic signals.

In the view of FIG. 1 the cable sleeve 110 is removed or stripped at an axial end of the cable 100. The length of the stripped region of the cable 100 may be 20 mm, for example. The underlying shielding braid 150 can be seen in the region of the cable 100 in which the cable sleeve 110 is removed.

Figure 2:
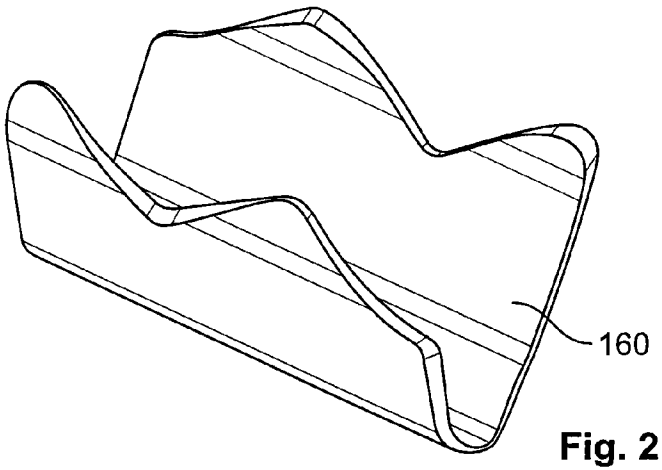
FIG. 2 shows a crimp sleeve.

FIG. 2 shows a perspective view of a crimp sleeve 160. The crimp sleeve 160 may consist, for example, of a metal. The crimp sleeve 160 is approximately U-shaped in cross-section. The crimp sleeve 160 may, for example, be 6.6 mm long.

Figure 3:
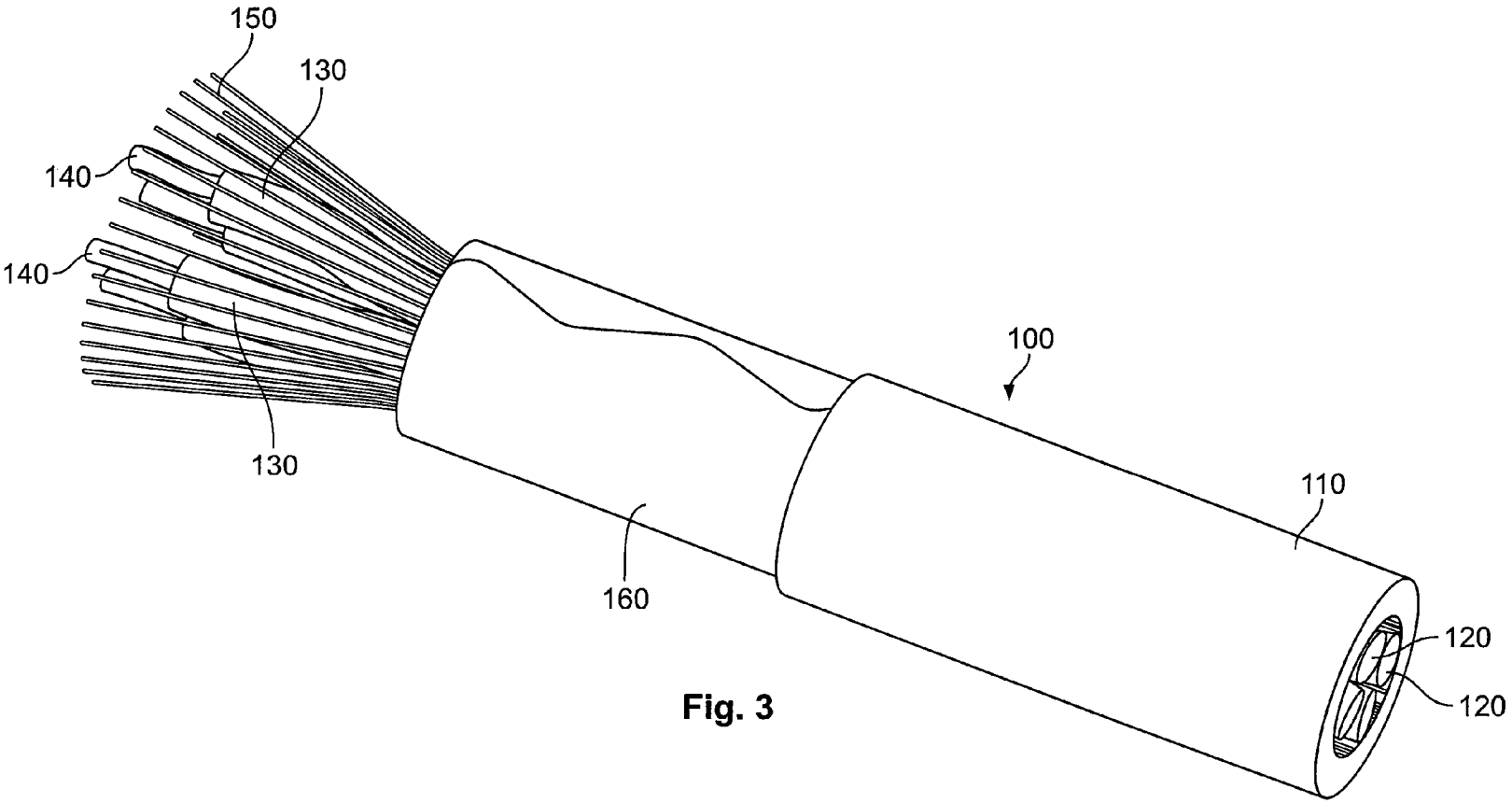
FIG. 3 shows the cable with a crimp sleeve fixed thereon.

In the view of FIG. 3 the crimp sleeve 160 has been crimped over the region of the cable 100 where the cable sleeve 110 has been removed. The crimp sleeve 160 is contacted as directly as possible with the remaining cable sleeve 110 of the cable 100. The distance between the crimp sleeve 160 and the remaining cable sleeve 110 should preferably be no more than 0.5 mm. At the opposite end of the crimp sleeve 160 the rest of the stripped region of the cable 100 protrudes from the crimp sleeve 160 via the exposed shielding braid 150.

Figure 4:
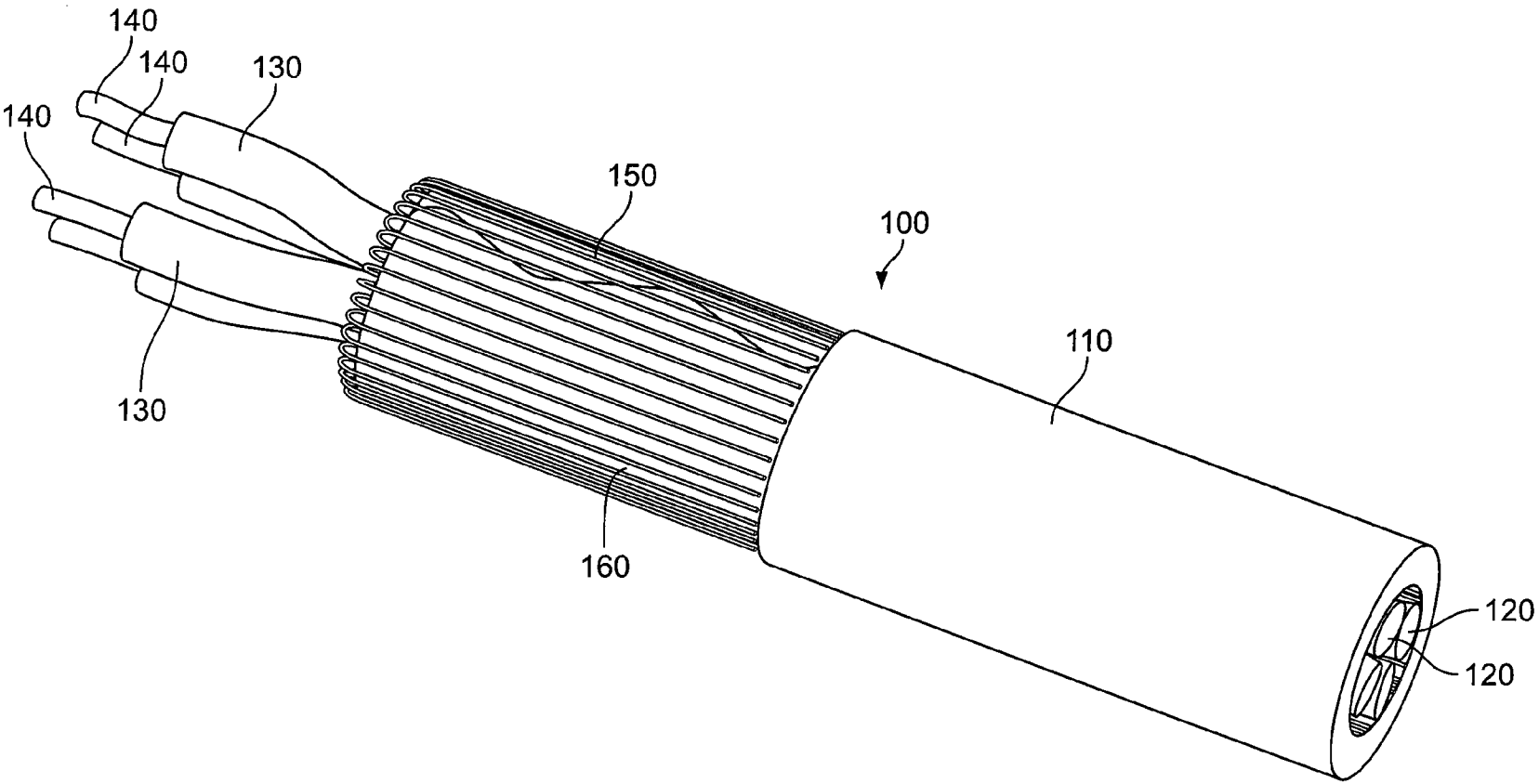
FIG. 4 shows the cable in a further processing state.

In the view of FIG. 4 the end portion of the shielding braid 150 protruding from the crimp sleeve 160 has been placed externally over the crimp sleeve 160 in the direction of the remaining cable sleeve 110. In addition, unless this has already been done previously, the four cores 120 of the cable 110, which are now exposed, have been stripped to a length of, for example, 2.5 mm. This means that, in this axial end portion of the cores 120, the core insulation 130 has been removed so that the bare wire 140 of the cores 120 can be seen.

Figure 5:
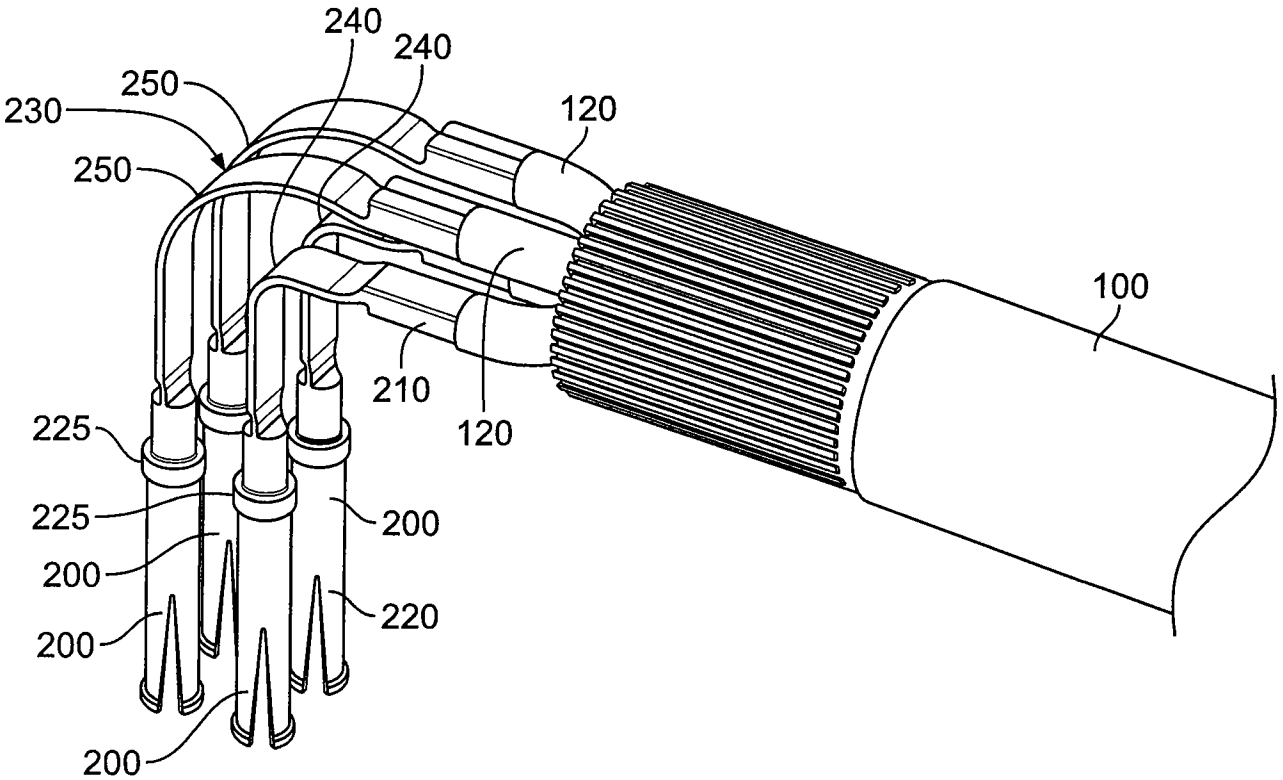
FIG. 5 shows the cable with contact elements attached thereto.

In the view of FIG. 5 a contact element 200 has been connected to each of the four stripped cores 120. The contact elements 200 consist of metal and are electrically conductive.

Each of the contact elements 200 comprises a crimp region 210, a bent region 230 and a socket region 220 along its longitudinal direction. The socket region 220 of each contact element 200 is formed as an elongate sleeve or as a hollow cylinder. A matching contact pin can thus be inserted into the socket region 220 of each contact element 200 so as to produce an electrical contact between the respective contact element 200 and the inserted contact pin.

The bent region 230, arranged between the socket region 220 and the crimp region 210, of each contact element 200 is formed in the embodiment shown in FIG. 5 as a long drawn-out, flat sheet metal. However, the bent regions 230 could also be formed as wires which are circular in cross-section.

The four contact elements 200 can be divided into two inner contact elements 240 and two outer contact elements 250. In the inner contact elements 240 the bent region 230 is shorter than in the outer contact elements 250. The distance between the socket region 220 and the crimp region 210 in the outer contact elements 250 is thus greater than in the inner contact elements 240.

Each of the contact elements 200 is bent in the bent region 230 by 90°. The bent regions 230 of the outer contact elements 250 have a greater bend radius than the bent region 230 of the inner contact elements 240. The socket regions 220 of the four contact elements 200 are oriented perpendicular to the direction of extension of the cable 100 owing to the bends in the contact elements 200. The different lengths of the bent regions 230 and the different bend radii in the bent regions 230 are dimensioned in such a way that the four socket regions 220 of the four contact elements 200 end at the height of a common plane.

The crimp region 210 of each contact element 200 is in each case crimped onto an exposed wire 140 of one of the cores 120 of the cable 100.

At the transition between the socket region 230 and the bent region 230, each of the contact elements 200 comprises a shoulder 225 at which the diameter of the corresponding contact element 200 tapers.

In an alternative assembly method the crimping of the crimp sleeve 160 onto the exposed shielding braid 150 of the cable 100 explained with reference to FIG. 3 and the reversal of the portion of the shielding braid 150 protruding from the crimp sleeve 160 over the crimp sleeve 160 explained with reference to FIG. 4 are only carried out now, once the contact elements 200 have been connected.

Figure 6:
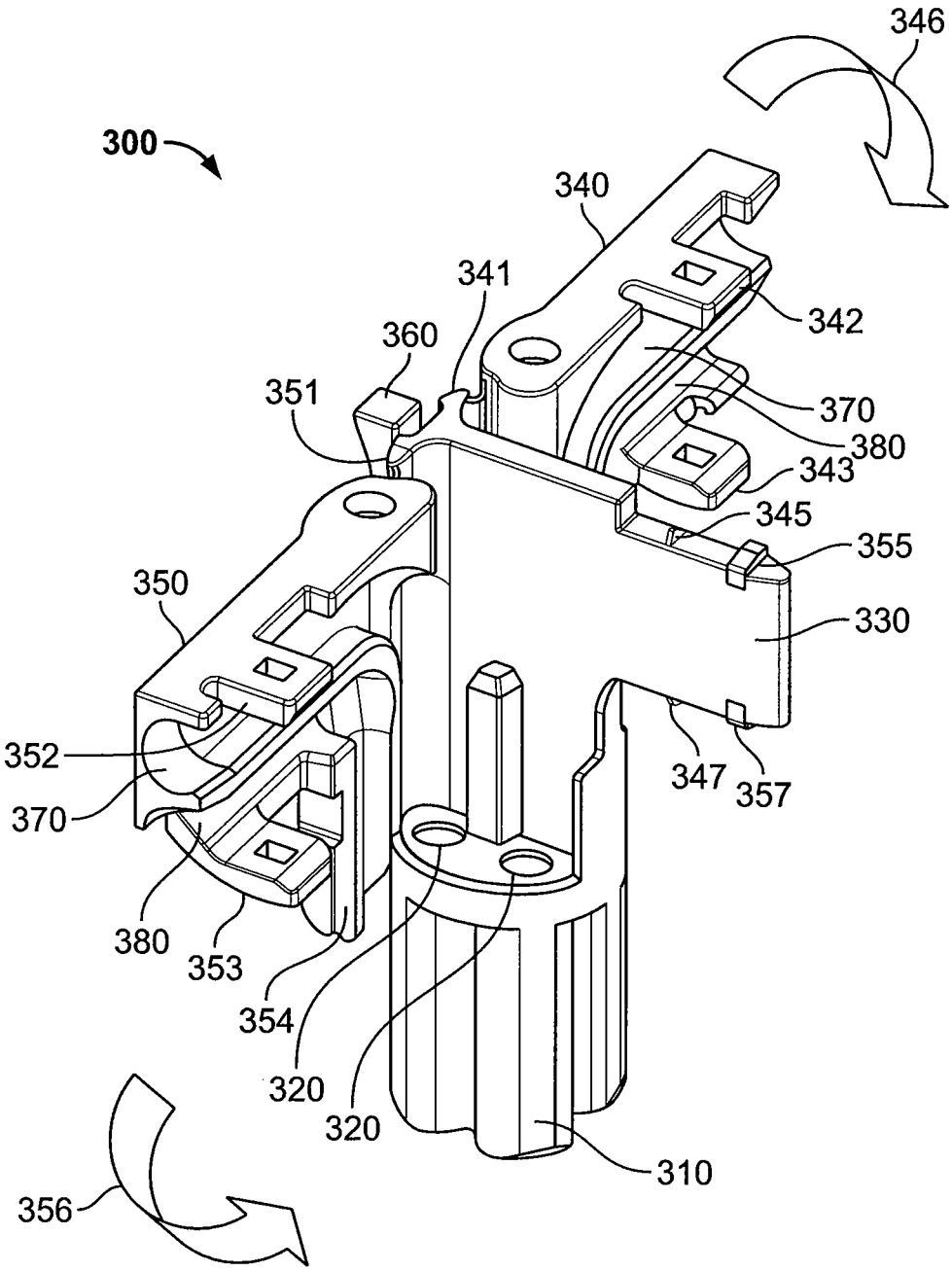
FIG. 6 shows a contact adapter.

FIG. 6 shows a perspective view of a contact adapter 300. The contact adapter 300 may consist, for example, of plastics material and may be produced by means of an injection moulding process. The contact adapter 300 comprises an approximately cylindrical base part 310. The base part 310 comprises four contact through-openings 320 which penetrate through the base part 310 in the longitudinal direction of the base part 310. The individual contact openings 320 are oriented parallel to one another and are approximately cylindrical.

A partition wall 330 is located on an end face of the base part 310 in such a way that two of the contact openings 320 are arranged on one side of the partition wall 330 and the other two contact openings 320 are arranged on the other side of the partition wall 330. The partition wall 330 extends parallel to the longitudinal direction of the base part 310.

The contact adapter 300 further comprises a first wing 340 and a second wing 350. The first wing 340 is connected to the partition wall 330 of the contact adapter 300 via a first hinge 341. The first hinge 341 is preferably formed as a living hinge. In this case the first wing 340 and the partition wall 330 may advantageously be formed in one piece. The second wing 350 is accordingly connected to the partition wall 330 via a second hinge 351. The second hinge 351 is also preferably formed as a living hinge.

The first hinge 341 makes it possible to pivot the first wing 340 about an axis of rotation parallel to the direction of longitudinal extension of the base part 310. The first wing 340 can be pivoted from an open position, in which the first wing 340 sticks out approximately at right angles from the partition wall 330, in a first pivot direction 346 into a closed position, in which the first wing 340 is oriented approximately parallel to the partition wall 330.

The second wing 350 is arranged on the side of the partition wall 330 opposite the first wing 340 and can be pivoted in the region of the second hinge 351 about an axis of rotation also oriented parallel to the direction of longitudinal extension of the base part 310. The second wing 350 can be pivoted from an open position, in which it sticks out approximately at right angles from the partition wall 330, in a second pivot direction 356 into a closed position, in which the second wing 350 is oriented approximately parallel to the partition wall 330. The pivot directions 346, 356 are oriented in opposite directions.

The inner faces of the wings 340, 350, which abut the partition wall 330 when the wings 340, 350 are closed, each comprise an outer guide groove 370 and an inner guide groove 380. The guide grooves 370, 380 each define a curved circular path and extend over an angle of approximately 90°, the radius of curvature of the outer guide grooves 370 being greater than that of the inner guide grooves 380. The outer guide grooves 370 are dimensioned in such a way that they can receive the bent region 230 of one of the outer contact elements 250. The inner guide grooves 380 are dimensioned in such a way that they can receive the bent region 230 of one of the inner contact elements 240.

The first wing 340 comprises a first upper locking element 342 and a first lower locking element 343 in the vicinity of its end remote from the first hinge 341. The first upper locking element 342 is arranged on the end of the first wing 340 distanced further from the base part 310, and the first lower locking element 343 is arranged on the side of the first wing 340 located closer to the base part 310. The second wing 350 comprises a second upper locking element 352 and a second lower locking element 353 in the vicinity of its end remote from the second hinge 341. The second upper locking element 352 is arranged on the side of the second wing 350 distanced further from the base part 310, and the second lower locking element 353 is arranged on the side of the second wing 350 located closer to the base part 310. The partition wall 330 comprises a first locking lug 345 and a second locking lug 355 on its narrow upper face remote from the base part 310. In addition, the partition wall 330 comprises a third locking lug 347 and a fourth locking lug 357 on a narrow face facing the base part 310. If the first wing 340 is pivoted about the first hinge 341 from the open position into the closed position, in which the first wing 340 is oriented approximately parallel to the partition wall 330, the first upper locking element 342 thus locks with the first locking lug 345 and the first lower locking element 343 thus locks with the third locking lug 347. If the second wing 350 is pivoted about the second hinge 351 from the open position into the closed position, in which the second wing 350 is oriented approximately parallel to the partition wall 330, the second upper locking element 352 thus locks with the second locking lug 345 and the second lower locking element 353 thus locks with the fourth locking lug 357.

The second wing 350 also comprises a second lateral locking element 354. The first wing 340 accordingly comprises a first lateral locking element 344. The first lateral locking element 344 is covered in FIG. 6 but can be seen in FIG. 9. When the first wing 340 and second wing 350 are closed, i.e. when the first wing 340 and second wing 350 are oriented approximately parallel to the partition wall 330, the first lateral locking element 344 of the first wing 340 and the second lateral locking element 354 of the second wing 350 lock together.

Owing to the locks described, the first wing 340 and the second wing 350 are held in their closed positions. A renewed opening of the wings 340, 350 is only possible if the described locked connections are unlocked simultaneously. The wings 340, 350 of the contact adapter 300 are generally closed just once during the assembly of the contact adapter 300 and then remain permanently in the closed position. It is also possible to dispense with one or more of the described locked connections.

The first wing 340 and the second wing 350 are approximately mirror symmetrical. Only the arrangement of the upper locking elements 342, 352 and the lower locking elements 343, 353 differs slightly. The first upper locking element 342 and the first lower locking element 343 are offset inwardly from the second upper locking element 352 and the second lower locking element 353 in the direction of the first hinge 341. When the wings 340, 350 are closed, the first upper locking element 342 is thus prevented from colliding with the second upper locking element 352, and the first lower locking element 342 is thus prevented from colliding with the second lower locking element 353. The lateral locking elements 344, 354 are also accordingly offset from one another. The first lateral locking element 344 is arranged closer to the base part 310 than the second lateral locking element 354.

The contact adapter 300 further comprises an outer locking element 360 which is arranged on the narrow face of the partition wall 330 oriented parallel to the longitudinal direction of the base part 310 in the vicinity of the first hinge 341 and of the second hinge 351.

Figure 7:
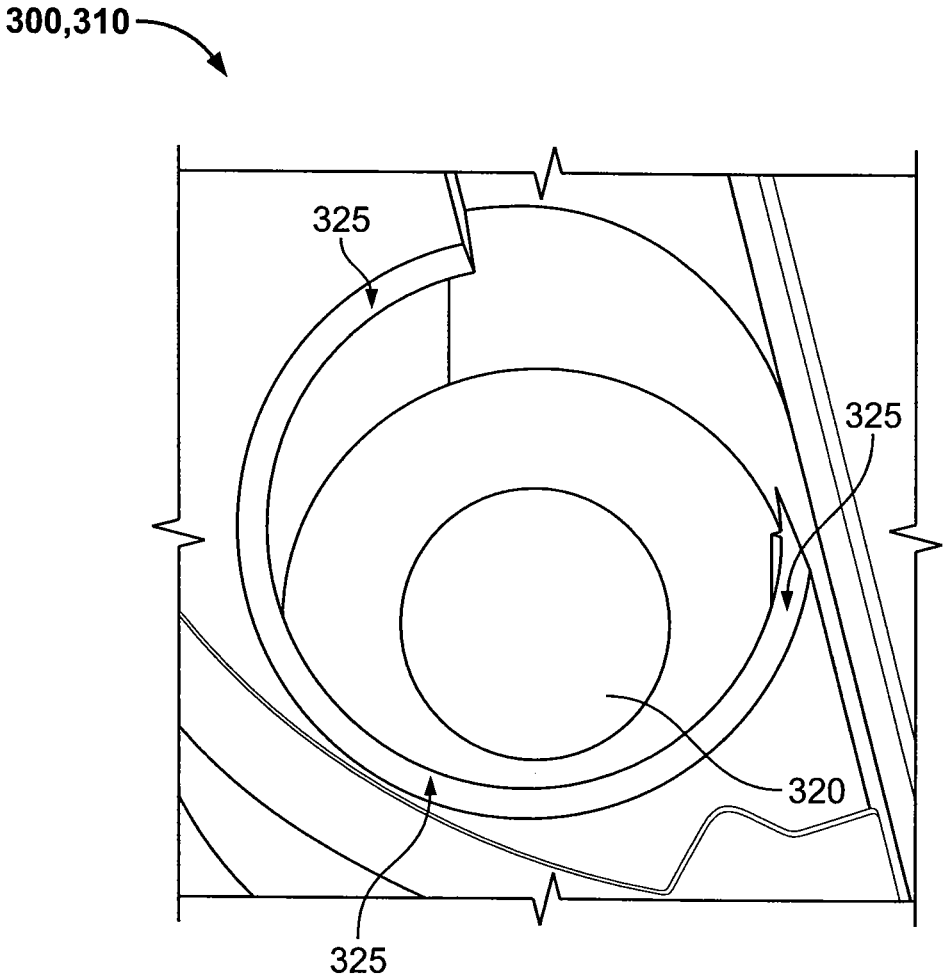
FIG. 7 shows a detail of the contact adapter.

FIG. 7 shows a detailed view of one of the contact openings 320 in the base part 310 of the contact adapter 300. It can be seen that the contact opening 320 is basically formed as a cylindrical through-opening. From the end of the contact opening 320 facing the partition wall 330, the contact opening 320 initially comprises a first, larger diameter. In the vicinity of the end of the contact opening 320, remote from the partition wall 330 the diameter of the contact opening 320 tapers to a second, smaller diameter. The socket region 220 of one of the contact elements 200 can thus be inserted into the contact opening 320 from above, without falling out again at the lower end of the contact opening 320.

FIG. 7 also shows that a total of three fixing ribs 325 are arranged on the side wall of the contact opening 320 and are oriented parallel to the direction of extension of the contact opening 320 and protrude inside the contact opening 320 from the side wall of the contact opening 320. The fixing ribs 325 fix a socket region 220 of a contact element 200 inserted into the contact opening 320 in the contact opening 320, whereby accidental removal of the contact element 200 from the contact opening 320 is prevented. Alternatively, this could also be achieved by more than or less than three fixing ribs 325.

Figure 8:
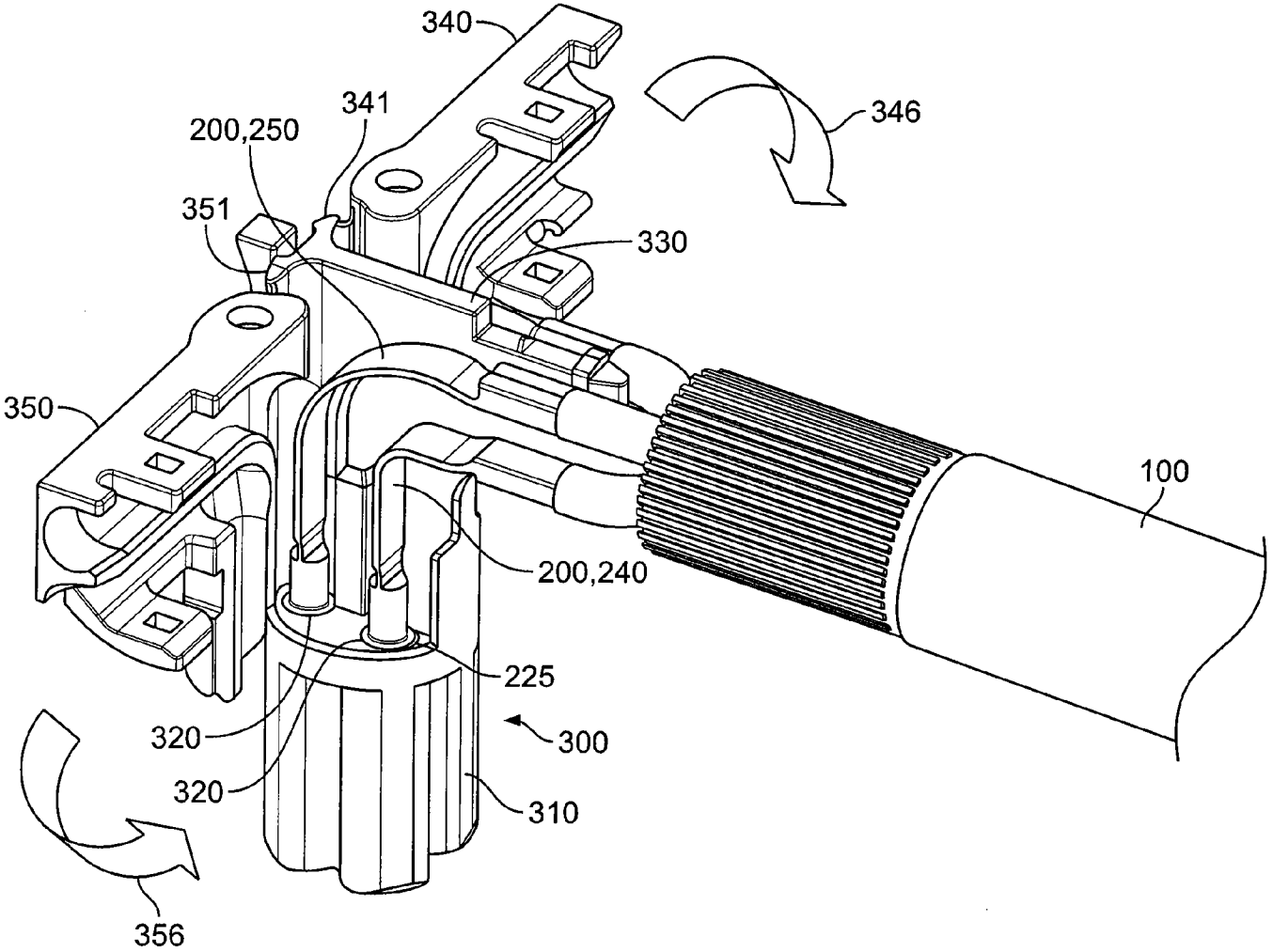
FIG. 8 shows the contact adapter with contact elements inserted.

FIG. 8 shows a further assembly step during the assembly of the electrical plug connector 1000. In the illustration of FIG. 8 the socket regions 220 of the four contact elements 200 have been inserted into the four contact openings 320 in the contact adapter 300. One of the outer contact elements 250 and one of the inner contact elements 240 are inserted into the two contact openings 320 on one side of the partition wall 330 of the contact adapter 300. The other outer contact element 250 and the other inner contact element 240 are inserted into the contact openings 320 on the other side of the partition wall 330 of the contact adapter 300. The lengths of the socket regions 220 of the contact elements 200 and the lengths of the contact openings 320 are dimensioned in such a way that the shoulders 225 of the socket regions 220 end flush with the upper end of the contact openings 320 facing the partition wall 330 in the base part 310.

Figure 9:
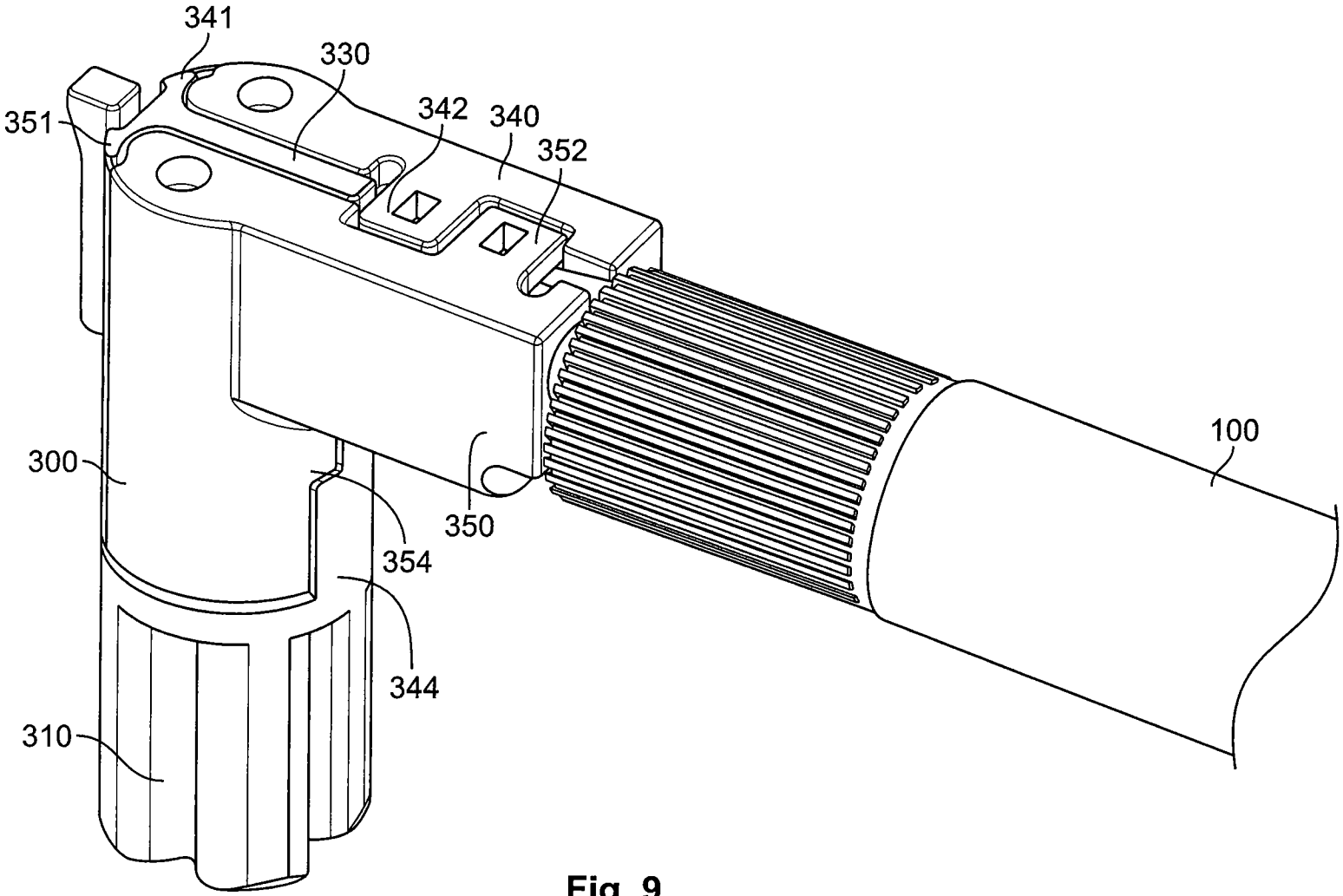
FIG. 9 shows the contact adapter with closed wings.

In the next processing step the wings 340, 350 are closed. For this purpose the first wing 340 is pivoted in the first pivot direction 346. The second wing 350 is pivoted in the second pivot direction 356, which is oriented in the opposite direction to the first pivot direction 346. FIG. 9 shows the contact adapter 300 with closed wings 340, 350.

As already explained with reference to FIG. 6, in the closed state the first upper locking element 342 of the first wing 340 is locked with the first locking lug 345 and the second upper locking element 352 is locked with the second locking lug 355. The lower locking elements 343, 353 are accordingly also locked with the third locking lug 347 and the fourth locking lug 357. In addition, the first lateral locking element 344 of the first wing 340 and the second lateral locking element 354 of the second wing 350 are locked together.

The bent regions 230 of the contact elements 200 are arranged in the guide grooves 370, 380 of the wings 340, 350 and are thus completely enclosed by the contact adapter 300. The fixing ribs 325 in the contact openings 320 constitute a first contact security means which prevents accidental removal of the contact elements 200 from the contact adapter 300. The shoulders 225 of the socket regions 220 are arranged below the closed wings 340, 350, which constitutes a second contact security means which also prevents accidental removal of the contact elements 200 from the contact adapter 300.

Figure 10:
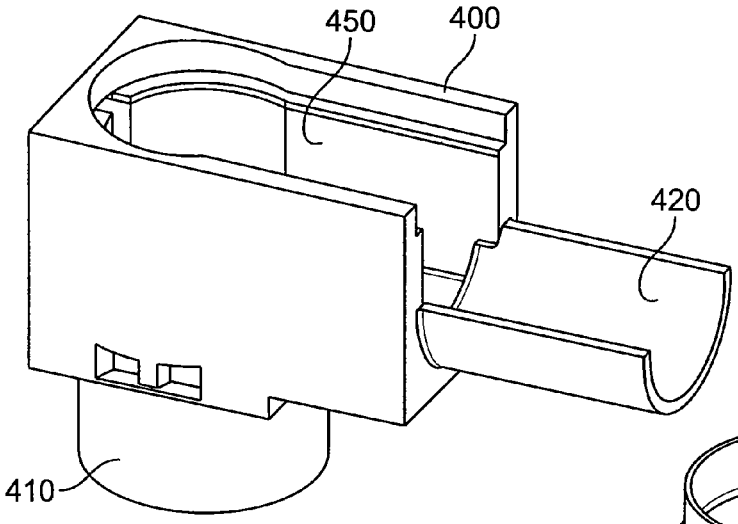
FIG. 10 shows a shielding housing.

FIG. 10 shows a perspective view of a shielding housing 400. The shielding housing 400 consists of an electrically conductive material, for example metal. Alternatively, the shielding housing 400 may also consist of a plastics material provided with a conductive coating. The shielding housing 400 comprises a substantially square portion with a recess forming an adapter receptacle region 450. The adapter receptacle region 450 is shaped in such a way that the contact adapter 300 of FIG. 9 can be arranged in the adapter receptacle region 450. The shielding housing 400 further comprises a contact connection piece 410 which is connected to the square portion and is substantially hollow cylindrical. In addition, the shielding housing 400 comprises a crimp region 420 which is connected to the square portion of the shielding housing 400 and is formed as a cylindrical half shell. The entire shielding housing 400 is preferably formed in one piece.

Figure 11:
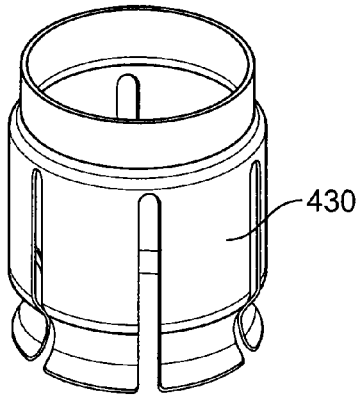
FIG. 11 shows a spring element.

FIG. 11 shows a view of a spring element 430. The spring element 430 consists of a resiliently deformable material, for example of a metal. The spring element 430 is substantially hollow cylindrical and comprises in its cylindrical outer surface a plurality of slits oriented parallel to the direction of extension of the spring element 430. These slits allow a resilient deformation of the spring element 430.

Figure 12:
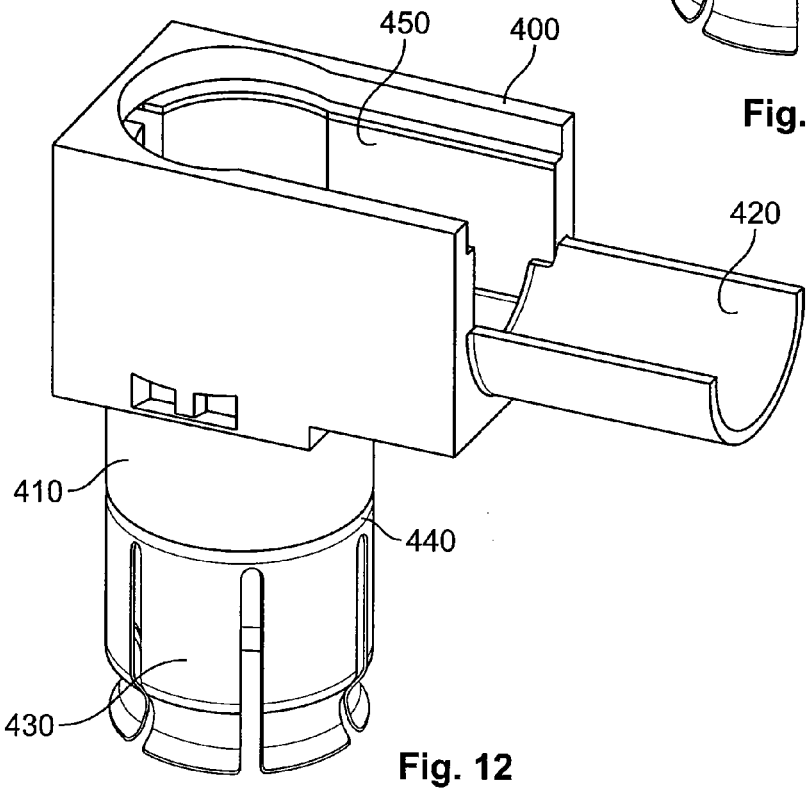
FIG. 12 shows the shielding housing with the spring element fixed thereon.

FIG. 12 shows the shielding housing 400 and the spring element 430 in the interconnected state. The spring element 430 is connected to the contact connection piece 410 of the shielding housing 400 and is soldered or spot-welded onto the contact connection piece 410 in a connection region 440.

Figure 13:
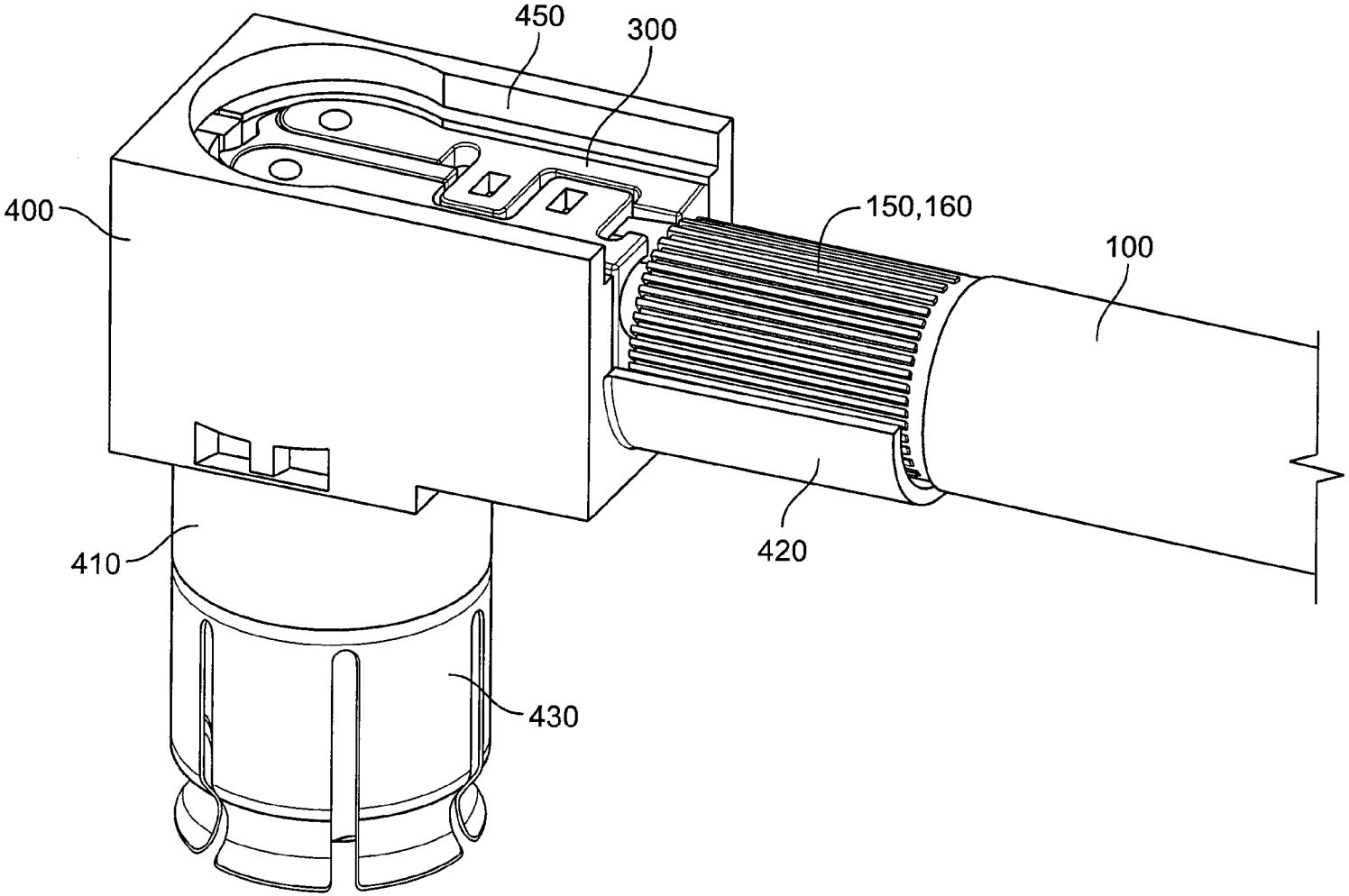
FIG. 13 shows the shielding housing with the contact adapter inserted therein.

FIG. 13 shows a further processing state during the assembly of the electrical plug connector 1000. In this processing state the contact adapter 300 fixed on the cable 100 is inserted into the adapter receptacle region 450 of the shielding housing 400. The base part 310 of the contact adapter 300 is arranged in the contact connection piece 410 and in the spring element 430 connected to the contact connection piece 410. The length of the base part 310 is dimensioned in such a way that the lower end of the base part 310 of the contact adapter 300 ends approximately flush with the lower end of the spring element 430. The crimp sleeve 160 on the cable 100 surrounded by the shielding braid 150 rests in the cylindrical-shell-shaped crimp region 420 of the shielding housing 400.

Figure 14:
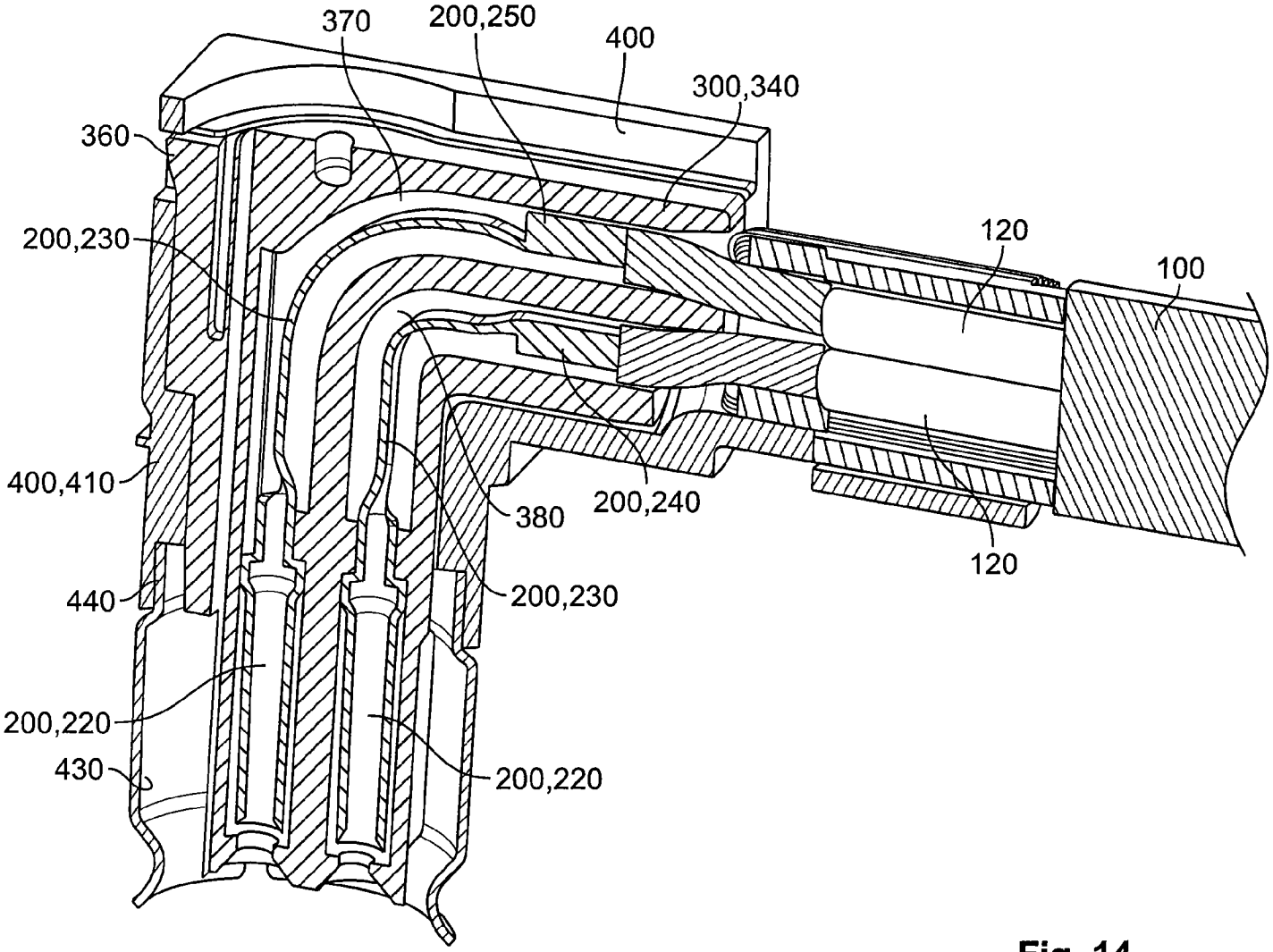
FIG. 14 shows a section through the shielding housing with the contact adapter inserted therein.

FIG. 14 shows a sectional view of the shielding housing 400 with the contact adapter 300 arranged therein and two contact elements 200 enclosed in the contact adapter 300. It can be clearly seen that the outer contact element 250 is arranged in an outer guide groove 370 and the inner contact element 250 is arranged in an inner guide groove 380. The socket regions 220 of the contact elements 200 arranged in the contact openings 320 in the base part 310 of the contact adapter 300 can also be seen. It can also be seen that the outer locking element 360 of the contact adapter 300 is locked in a recess in the shielding housing 400. Accidental removal of the contact adapter 300 from the shielding housing 400 is thus prevented.

Figure 15:
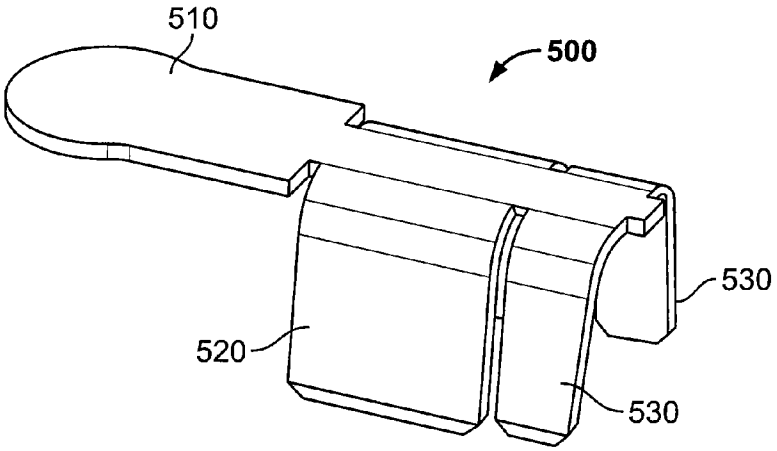
FIG. 15 shows a cover sheet.

FIG. 15 shows a perspective view of a cover sheet 500. The cover sheet 500 preferably consists of an electrically conductive material, for example a metal. However, the cover sheet 500 may also consist of a metal-coated plastics material. The cover sheet 500 comprises a cover region 510. The cover sheet 500 comprises a first tab 520 and a second tab 530 connected to the cover region 510. The cover sheet 500 is preferably formed in one piece.

Figure 16:
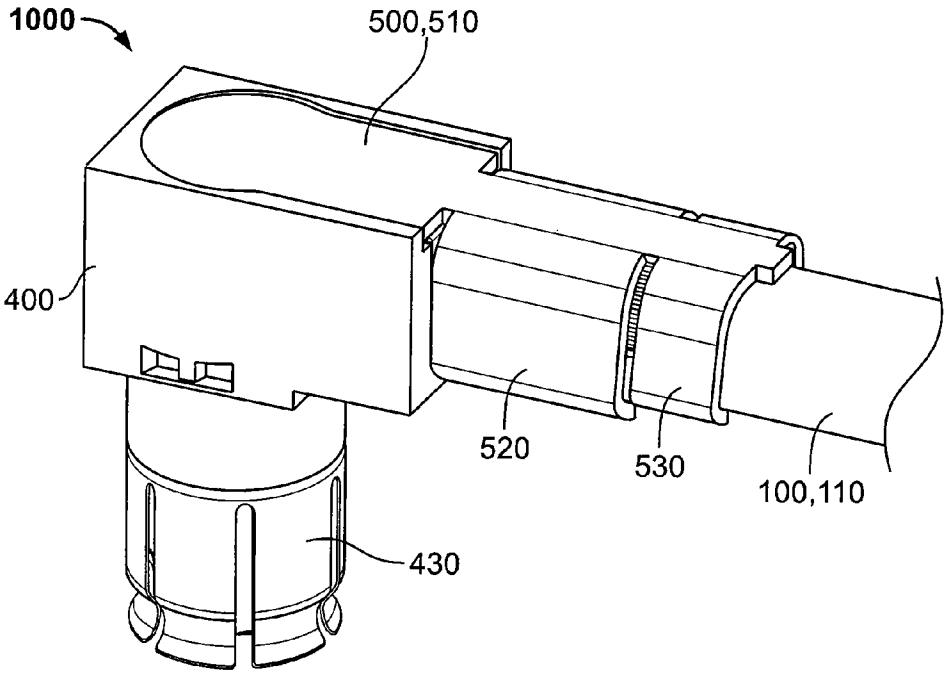
FIG. 16 shows the shielding housing with the cover sheet positioned thereon.

FIG. 16 shows the shielding housing 400 with the cover sheet 500 fixed thereto. The cover region 510 of the cover sheet 500 is fitted onto the receptacle region 450 of the shielding housing 400 and thus closes the opening, through which the contact adapter 300 was previously inserted into the shielding housing 400. The first tab 520 of the cover sheet 500 is crimped onto the cable 100 in the region of the shielding braid 150 and the crimp sleeve 160. The second tab 530 is crimped on the cable sleeve 110 of the cable 100. The crimp connections between the tabs 520, 530 and the cable 100 prevent accidental removal of the cover sheet 500 from the shielding housing 400. In addition, the crimp connections between the tabs 520, 530 and the cable 100 constitute a strain relief of the cable 100. The cover region 510 of the cover sheet 500 and the shielding housing 400 completely surround the contact adapter 300 arranged in the shielding housing 400 and thus completely shield the contact adapter 300 electromagnetically.

FIG. 17 shows the electrical plug connector 1000 in the fully assembled state. The shielding housing 400 of the electrical plug connector 1000 is now inserted into a coding member 600. The coding member 600 may consist, for example, of plastics material and ensures that the electrical plug connector 1000 can only be connected to the plug connector counterpart provided therefor. For this purpose, the coding member 600 comprises a plurality of coding elements 610 which may be formed, for example, as webs arranged on the outer periphery of the coding member 600. For example, the plug connector counterpart may be formed as a plug socket which comprises grooves corresponding to the coding elements 610. In addition, the coding member 600 comprises a locking element 620 which locks the electrical plug connector 1000 to the plug connector counterpart. In a simplified embodiment of the plug connector 1000, the coding member 600 may be omitted.

In a further simplified embodiment of the plug connector 1000, the contact adapter 300 comprises just one of the wings 340, 350. It is also possible to provide merely either the inner guide grooves 380 or the outer guide grooves 370 in one or both of the wings 340, 350. In these simplified embodiments the plug connector 1000 can be used to contact just one or two cores 120 of the cable 100. Of course, it is also possible for example to arrange three guide grooves with different radii of curvature in each of the wings 340, 350 so that the plug connector 1000 can be used to contact a total of six cores 120 of the cable 100.

The invention claimed is:

1. Electrical plug connector comprising an insulating contact adapter, wherein the contact adapter has a first wing which can be pivoted between an open and a closed position, the contact adapter being designed to enclose a metal contact element between the first wing and a wall of the contact adapter when the first wing is in the closed position, the first wing comprising a guide groove for receiving the contact element, wherein the guide groove comprises a curved portion which extends over an angle of approximately 90°, the guide groove pivoting with the first wing between the open and closed position.

2. Electrical plug connector according to claim 1, wherein the contact adapter comprises a base part having a contact through-opening for receiving a socket region of the contact element.

3. Electrical plug connector according to claim 2, wherein at least one rib is arranged in the contact through-opening to fix the contact element.

4. Electrical plug connector according to claim 1, wherein the first wing is connected to the contact adapter via a living hinge.

5. Electrical plug connector according to claim 1, wherein the first wing comprises a locking element which is provided to lock the first wing in its closed position.

6. Electrical plug connector according to claim 1, wherein the contact adapter comprises a second wing which can be pivoted in an opposite direction to the first wing between an open and a closed position.

7. Electrical plug connector according to claim 6, wherein each of the wings comprises two guide grooves for receiving two contact elements each.

8. Electrical plug connector according to claim 1, wherein the plug connector comprises a shielding housing and a spring element connected to the shielding housing, wherein the contact adapter can be locked in the shielding housing.

9. Electrical plug connector according to claim 8, wherein the plug connector comprises a cover sheet which is designed to be positioned on the shielding housing and crimped with a cable.

10. Electrical plug connector according to claim 1, wherein the plug connector comprises a coding member having at least one coding element.

11. Electrical plug connector according to claim 1, wherein the plug connector is provided for the transfer of a high-frequency signal.

12. Electrical plug connector according to claim 1, wherein the contact element extends in a curved portion over an angle of approximately 90°.

13. Electrical plug connector according to claim 12, wherein the contact element is fixated in the guide groove in all three spatial directions.

14. Electrical plug connector according to claim 13, wherein movements of the contact element in two spatial directions are blocked by perpendicular portions of the curved guide groove and wherein movements of the contact in a third spatial direction are blocked by the wing or the wall of the contact adapter itself.

15. Method for assembling an electrical plug connector, comprising the following steps:

bending a contact element connected to a core of a cable in such a way that the contact element extends in a curved portion over an angle of approximately 90°;

inserting an end portion of the contact element into a contact opening of a contact adapter;

pivoting a wing of the contact adapter into a closed position in such a way that the curved portion of the contact element is enclosed in a guide groove of the first wing between the wing and a wall of the contact adapter; and wherein four contact elements connected to four cores of the cable are bent, two of the contact elements being bent with a smaller bend radius and two of the contact elements being bent with a larger bend radius, and in that two wings of the contact adapter are pivoted in closed positions in such a way that, in each case, two contact elements are enclosed between each of the wings and the wall of the contact adapter.

16. Method for assembling an electrical plug connector, comprising the following steps:

bending a contact element connected to a core of a cable in such a way that the contact element extends in a curved portion over an angle of approximately 90°;

inserting an end portion of the contact element into a contact opening of a contact adapter;

pivoting a wing of the contact adapter into a closed position in such a way that the curved portion of the contact element is enclosed in a guide groove of the first wing between the wing and a wall of the contact adapter, wherein the guide groove pivots with the first wing between an open and closed position.

17. Method according to claim 16, wherein four contact elements connected to four cores of the cable are bent, two of the contact elements being bent with a smaller bend radius and two of the contact elements being bent with a larger bend radius, and in that two wings of the contact adapter are pivoted in closed positions in such a way that, in each case, two contact elements are enclosed between each of the wings and the wall of the contact adapter.

18. Method according to claim 16, wherein the contact element is fixated in the guide groove in all three spatial directions.

19. Method according to claim 18, wherein movements of the contact element in two spatial directions are blocked by perpendicular portions of the curved guide groove and wherein movements of the contact in a third spatial direction are blocked by the wing or the wall of the contact adapter itself.

* * * * *